US008137150B2

(12) United States Patent
Oestreicher

(10) Patent No.: US 8,137,150 B2
(45) Date of Patent: Mar. 20, 2012

(54) INFANT TOYS AND NOVELTIES USING A PLURALITY OF TAGS

(76) Inventor: Paul Oestreicher, Westport, CT (US)

( * ) Notice: Subject to any disclaimer, the term of this patent is extended or adjusted under 35 U.S.C. 154(b) by 1341 days.

(21) Appl. No.: 11/047,295

(22) Filed: Jan. 31, 2005

(65) Prior Publication Data

US 2005/0170742 A1 Aug. 4, 2005

Related U.S. Application Data

(60) Provisional application No. 60/540,132, filed on Jan. 29, 2004.

(51) Int. Cl.
*A63H 33/00* (2006.01)

(52) U.S. Cl. ..... 446/227; 446/85; 446/490; 446/901

(58) Field of Classification Search ..... 446/227, 446/85, 490, 901
See application file for complete search history.

(56) References Cited

U.S. PATENT DOCUMENTS

| | | | | |
|---|---|---|---|---|
| 1,047,703 A | | 12/1912 | Rapson | |
| 2,798,305 A | | 4/1957 | Weil | 15/244 |
| 4,131,276 A | * | 12/1978 | Judkins | 473/575 |
| 4,756,529 A | | 7/1988 | Stillinger | 273/58 |
| 4,900,632 A | | 2/1990 | McGrath | 428/542.8 |
| 4,927,141 A | | 5/1990 | Paranto | 273/58 K |
| 5,186,457 A | * | 2/1993 | Cole | 473/575 |
| 5,516,099 A | | 5/1996 | Strong | 273/58 K |
| 5,551,687 A | * | 9/1996 | Krull | 473/573 |
| 6,280,356 B1 | * | 8/2001 | Sandeen | 473/614 |
| 6,306,052 B1 | | 10/2001 | Hollis et al. | 473/573 |
| 6,427,265 B1 | | 8/2002 | Dix | 5/482 |

* cited by examiner

*Primary Examiner* — Gene Kim
*Assistant Examiner* — Urszula M Cegielnik
(74) *Attorney, Agent, or Firm* — St. Onge Steward Johnston & Reens LLC

(57) ABSTRACT

An infant toy is disclosed generally comprising a core section and a plurality of tags interconnected about the core section substantially forming the toy. The tags may be different lengths, widths, and colors, and may have different designs printed thereon, in order to further stimulate the infant. In certain embodiments, the tags are fabric loops, and in some embodiments, the toy has a handle member or a connector for attaching the toy to an accessory, such as car keys or a zipper pull. In some embodiments, the tags are arranged in an annular fashion such that they can be worn on the wrist or in the hair.

21 Claims, 4 Drawing Sheets

INFANT TOYS AND NOVELTIES USING A PLURALITY OF TAGS

RELATED APPLICATIONS

This patent application claims the benefit of, under Title 35, United States Code, Section 119(e), U.S. Provisional Patent Application No. 60/540,132, filed Jan. 29, 2004.

FIELD OF THE INVENTION

The present invention relates to a novelty item or toy for infants. More specifically, the invention relates to a toy formed from a plurality of tags or strips such as those customarily found singly on stuffed animals or the like.

BACKGROUND OF THE INVENTION

Often, a tag is sewn onto a stuffed animal or other infant toy in order to provide information about the toy and/or its manufacturer, such as instructions for cleaning the toy, the address of the manufacturer, or notice of trademarked or copyrighted features of the toy. Such a tag is generally designed to be relatively inconspicuous and is not intended to be a primary feature of the toy. However, many infants seem to focus their attention on the tag more than on any other feature of the stuffed toy. Often, they seem to spend more time grabbing, biting and sucking on the tags than they spend playing with the actual toy to which the tag is attached. As such, even though adults typically have no idea why the tag is more compelling to infants than the toy itself, it is desirable to give such infants what they want—a toy formed from a plurality of tags.

U.S. Pat. No. 6,427,265 ("the '265 patent") apparently recognizes infants' fascination with tags, and attempts to capitalize on this fascination by providing a blanket having multiple tags attached thereto. However, while the '265 patent does provide an item having multiple tags, this item is not formed from the tags themselves. Instead, the item is a large article designed to serve other purposes, with a number of tags attached along its perimeter. It would be more desirable for the primary function of the item to be small body which the infant can handle and manipulate with ease, and the primary purpose of which is to allow the infant to engage the tags.

U.S. Pat. No. 5,551,687 ("the '687 patent") similarly recognizes this fascination with tags, providing a toy having multiple tags that serve a variety of purposes including amusement, education, and/or third party advertising. However, while the '687 patent does provide a toy having multiple tags, this toy is also not formed from the tags themselves. Rather, the toy disclosed in the '687 patent has a soft stuffed body, to which several tags are attached. It would be more desirable for the toy (or at least a large portion thereof) to be formed primarily from the tags themselves, much like a Koosh® Ball manufactured by OddzOn Products of Campbell, Calif.

U.S. Pat. No. 4,756,529 ("the '529 patent") appears to be directed to the Koosh® Ball itself. As those skilled in the art may be aware, the '529 patent (of which the Koosh® Ball is an embodiment) is directed to an amusement device which has a substantially spherical configuration, and which is formed from a large plurality of floppy, elastomeric filaments that radiate in a dense, bushy manner from a central core region. The filaments are sufficiently floppy to collapse on impact, and thus, absorb enough energy to avoid any tendency to bounce. They are also sufficiently dense and floppy that they tend to quickly thread their way between the fingers of a user upon contact with the hand. These features promote sure and quick capture of the device during the act of catching. U.S. Pat. No. 4,927,141 discloses a similar novelty ball having a multiplicity of extending, flexible, whisker-like protrusions, but having far fewer than the novelty ball disclosed in the '529 patent.

While the Koosh® Ball was no doubt a popular item with desirable properties (in fact, it was one of the best-selling novelty items of the late 1980's), it may not be appropriate for certain users, particularly infants. This is true because the Koosh® Ball is formed essentially from a plurality of rubber-band like fibers, which may not be appropriate for infants with a tendency for putting things in their mouths (i.e., most infants). Such a material may even present a significant choking hazard should the fibers break off from the toy.

U.S. Pat. No. 5,516,099 ("the '099 patent") and U.S. Pat. No. 6,306,052 ("the '052 patent") both disclose balls including core elements with multiple loops extending from their exterior surfaces. The loop elements extend outward from the cores of the balls, permitting users to catch the balls simply by allowing one or more of the loops to pass over their fingers (as is the case in the '099 patent), or by using catching devices having specially configured bristles (as is the case with the '052 patent). Again, however, these balls are not appropriate/desirable for infants to play with.

What is desired, therefore, is an infant toy or novelty formed from a plurality of tags such as those customarily found singly on stuffed animals or the like. What is further desired is an infant toy that does not represent a health or choking hazard.

SUMMARY OF THE INVENTION

Accordingly, it is an object of the present invention to provide an infant toy or novelty that is formed primarily from a plurality of individual tags customarily found on infant toys such as stuffed animals.

It is a further object of the present invention to provide an infant toy or novelty formed from a plurality of tags arranged such that it can be easily used and/or manipulated by an infant.

It is yet another object of the present invention to provide an infant toy or novelty formed from a plurality of strips using materials that are appropriate for infants to put in their mouths.

It is still another object of the present invention to provide an infant toy or novelty formed from a plurality of strips of a size that is appropriate for infants to put in their mouths.

In order to overcome the deficiencies of the prior art and to achieve at least some of the objects and advantages listed, the invention comprises an infant toy or novelty including a core section, a plurality of tags interconnected about the core section, wherein each of the tags includes an elongated strip of fabric, a width and a thickness, wherein the thickness is significantly smaller than the width, and a first end and a second end, wherein the first and second ends are connected at the core section so that the strip of fabric comprises a loop, wherein the loops extend outwardly from the core section in a plurality of planes, wherein each of the loops extends out from the core section, and wherein the first and second ends of the plurality of tags are sewn together, such that the core section comprises the plurality of the first and second ends of the plurality of tags.

In another embodiment, the invention comprises an infant toy or novelty including a core section having a maximum diameter, a plurality of tags interconnected about the core section, wherein each of the tags comprises an elongated piece of fabric, wherein each of the tags has a length, the length being larger than the maximum diameter of the core section, wherein each of the tags has a width and a thickness, the width being substantially larger than the thickness, and wherein the plurality of tags extend outwardly from the core section in a plurality of planes.

In yet another embodiment, the invention comprises an infant toy or novelty including a core section, a plurality of strips connected to the core section, wherein each of the strips comprises an elongated piece of pliable material, wherein each of the strips has a length, the length being larger than the maximum diameter of the core section, wherein each of the strips has a width and a thickness, the width being substantially larger than the thickness, and wherein the plurality of tags extend outwardly from the core section in a plurality of planes.

In still another embodiment, the invention comprises an infant toy or novelty including an annular support member, and a plurality of tags connected to the support member, wherein each of the tags includes an elongated strip of fabric, a width and a thickness, wherein the thickness is significantly smaller than the width, and wherein each of the tags extends out from the annular support member.

DETAILED DESCRIPTION OF THE DRAWINGS

Figure 1:
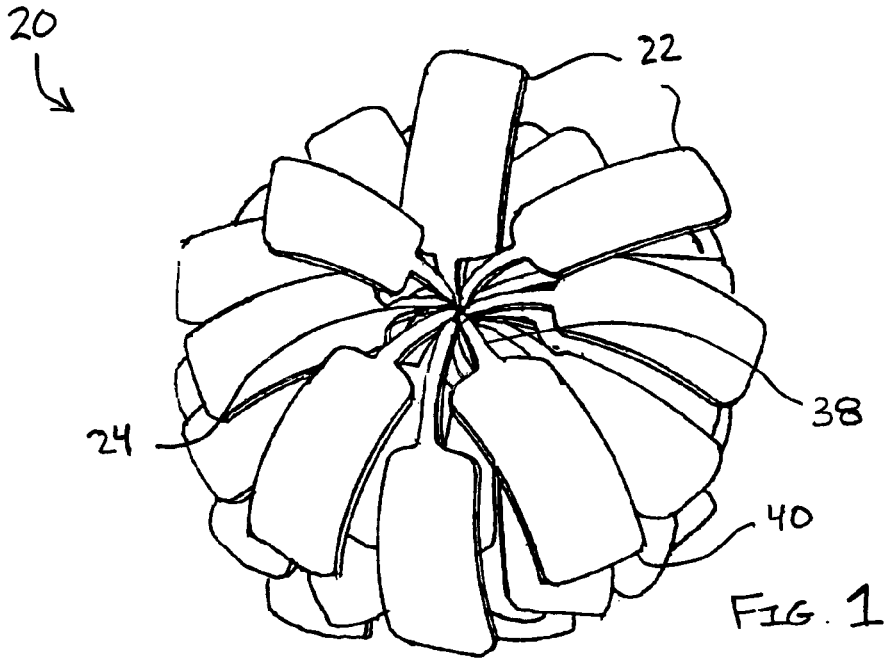
FIG. 1 is an isometric view of an infant toy in accordance with the invention.

The basic components of one embodiment of an infant toy or novelty in accordance with the invention are illustrated in FIG. 1. The toy 20 includes a plurality of strips 22 that are connected about a core section 24 and extend out in a plurality of planes therefrom. In certain advantageous embodiments, the strips 22 are elongated strips of fabric. These tags may be cotton, polyester, silk, or any other material that is soft enough and safe enough to be desirable for an infant. Moreover, given the likelihood that the toy will often be in the mouth of an infant, these tags will typically be made from a material that is washable.

Each tag 22 has a length to which it extends out from the core section 24. Each tag 22 also has a width, which is substantially larger than the thickness of the tag 22. In certain advantageous embodiments, each tag 22 extends out from the core section less than about three inches and is less than about two inches wide.

Figure 2:
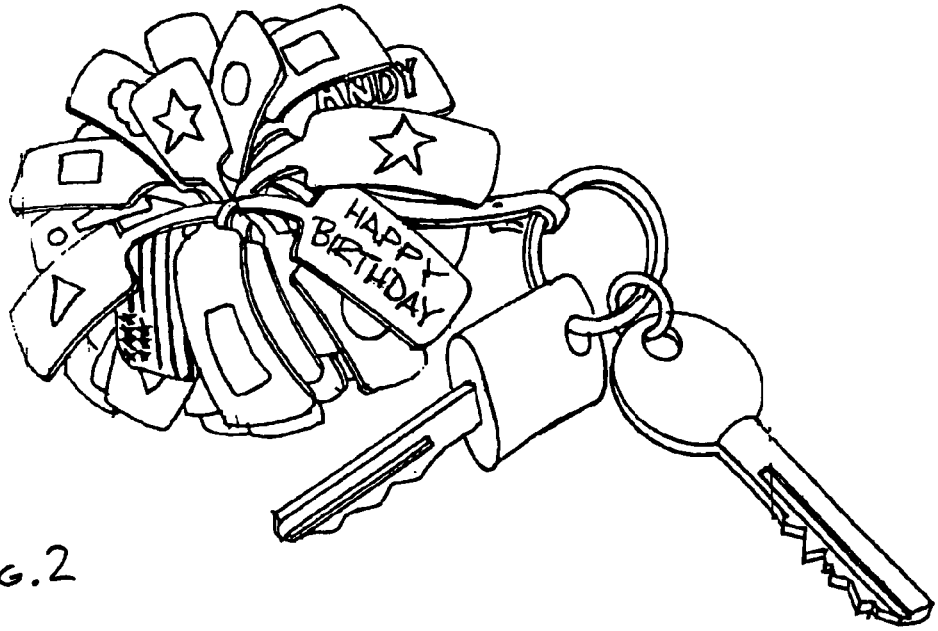
FIG. 2 is an isometric view of the infant toy of FIG. 1 attached to an accessory.

All of the tags comprising a single toy 20 may be identical, or multiples of several tag configurations may be employed. For instance, as illustrated in FIG. 2, the plurality of tags 22 may be different sizes and lengths in order to further stimulate an infant. The tags may be customized, for example, with a child's name or with a brief message. The toys may be used for collecting, in games, or for corporate promotion purposes, and the tags thereof may accordingly include, for example, a corporation's name, motto, logo, brand, etc. The tags may be designed for special occasions, such as birthdays, Valentine's Day, Chanukah, Christmas, etc. The tags may be printed, for example, with different shapes, with cartoon characters, flags of different countries, with organization colors, with the colors or logos of professional sports teams, etc. As should be recognized by those skilled in the art, a substantially unlimited number of customization options exist. Moreover, different toys 20 may be a different sizes or colors, or series of colors, or may have a different design or pattern illustrated on the tags 22, which may even be unique to that particular toy 10, such that the toy 20 can be marketed as a collectible.

Figure 3:
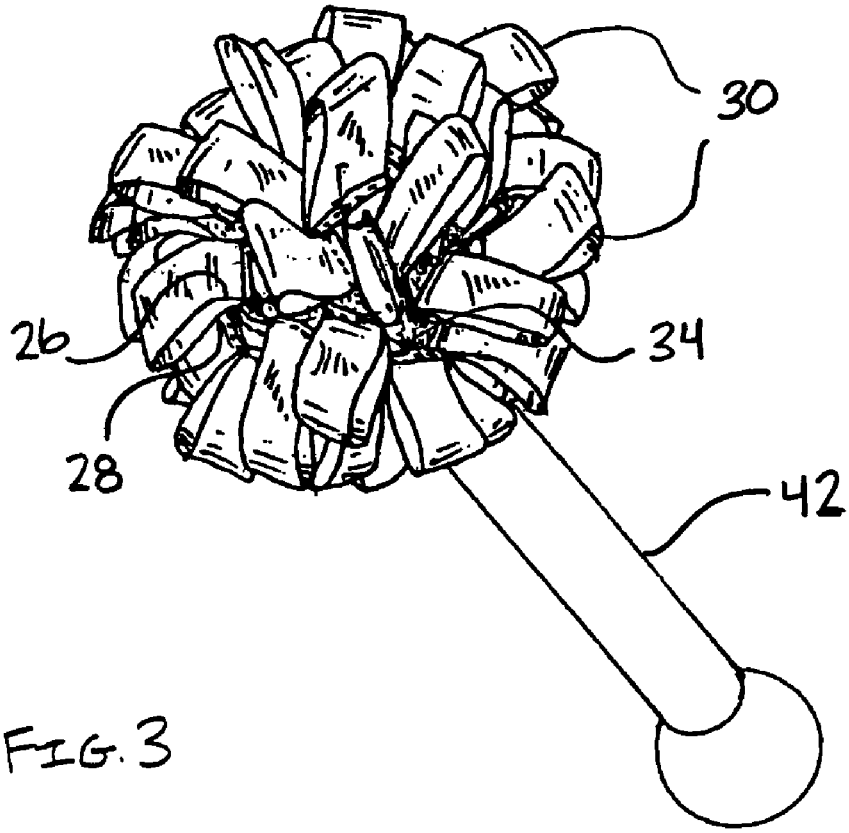
FIG. 3 is an isometric view of the infant toy of FIG. 1 with a handle member.

As illustrated in FIG. 3, in certain advantageous embodiments, the fabric tag 22 includes a first end 26 and a second end 28, and the first and second ends 26, 28 are both sewn together at the core section 24 so as to form a loop 30. Accordingly, an infant is able to easily grab and finger the tags 22, as is typical of the tags present on stuffed animals and the like.

Figure 4:
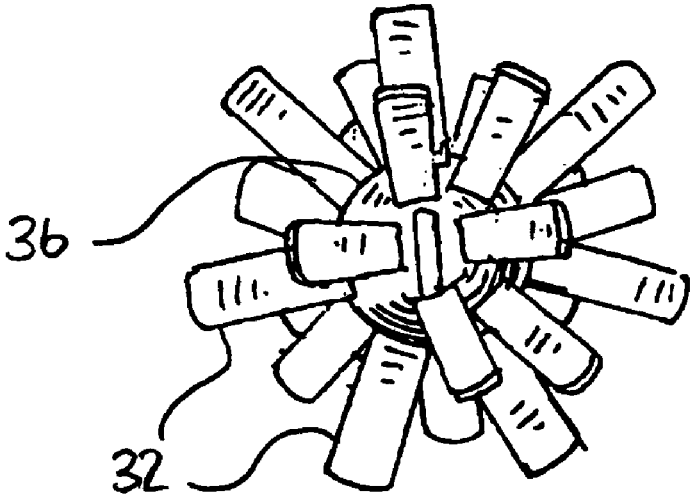
FIG. 4 is an isometric view of the infant toy of FIG. 1 using strips of pliable material.

While, in some embodiments, the strips 22 are fabric tags, in other advantageous embodiments, and as illustrated in FIG. 4, strips 32 of pliable material that is suitable for an infant's mouth may be employed, such as may be appropriate for when an infant is teething. In some of these embodiments, the strips 32 may be hollow or have a cavity therein such that it can be filled with a liquid or a gel to make it more suitable and soothing for teething infants who bite the strips 32.

In certain embodiments, the core section 24 comprises a body 36 to which multiple tags or strips can be connected. A body 36 may be made out of any of various materials, such as fabric, rubber, or plastic, and may, for example, comprise a small spherical body. Accordingly, the tags or strips may be integrally formed with the body 36, as shown in FIG. 4. In other embodiments, tags or loops may be sewn to a body 34, as shown in FIG. 3, or may be otherwise connected to such a body. As illustrated in FIG. 1, in other embodiments, the core section 24 simply comprises portions of the plurality of tags 22—i.e., at the point where the tags are interconnected. This is the case, for example, in embodiments where the plurality of tags 22, which have an inner end 38 and an outer end 40, are simply sewn together at the inner end 38 in order to create the toy 20. Typically, the maximum diameter of the core section 24 is smaller than the length of the tags or strips.

As illustrated in FIG. 3, the toy 20 may also include a handle member 42. Accordingly, an infant is able to grasp one end of the toy 20 and finger, mouth, or shake the other. The handle 42 may be wood, plastic, rubber, etc., and it may incorporate a rattle or other device for attracting and maintaining the attention of an infant. A core section 24, with plurality of tags 22 attached thereat, may be located at one or both ends of the handle member 42.

Figure 5A:
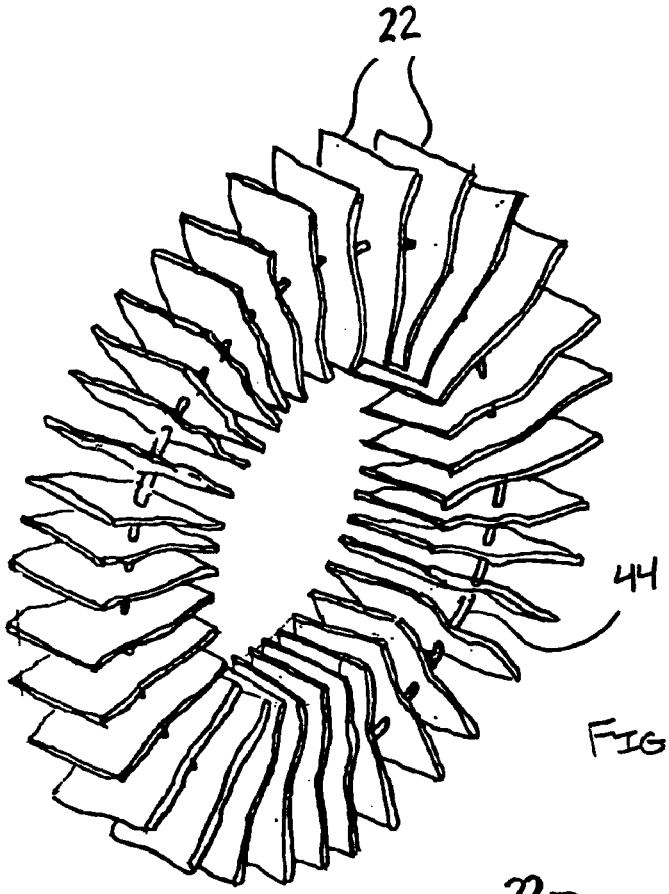
FIG. 5A is an isometric view of infant toy of FIG. 1 where the tags are connected by an annular support member.
Figure 5B:
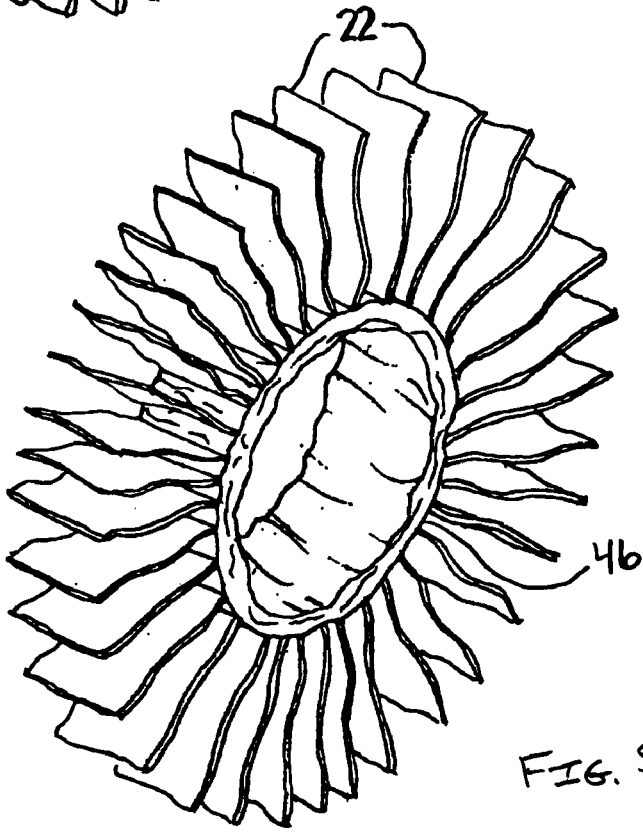
FIG. 5B is an isometric view of the infant toy of FIG. 1 where the tags are connected to an annular support member.
Figure 5C:
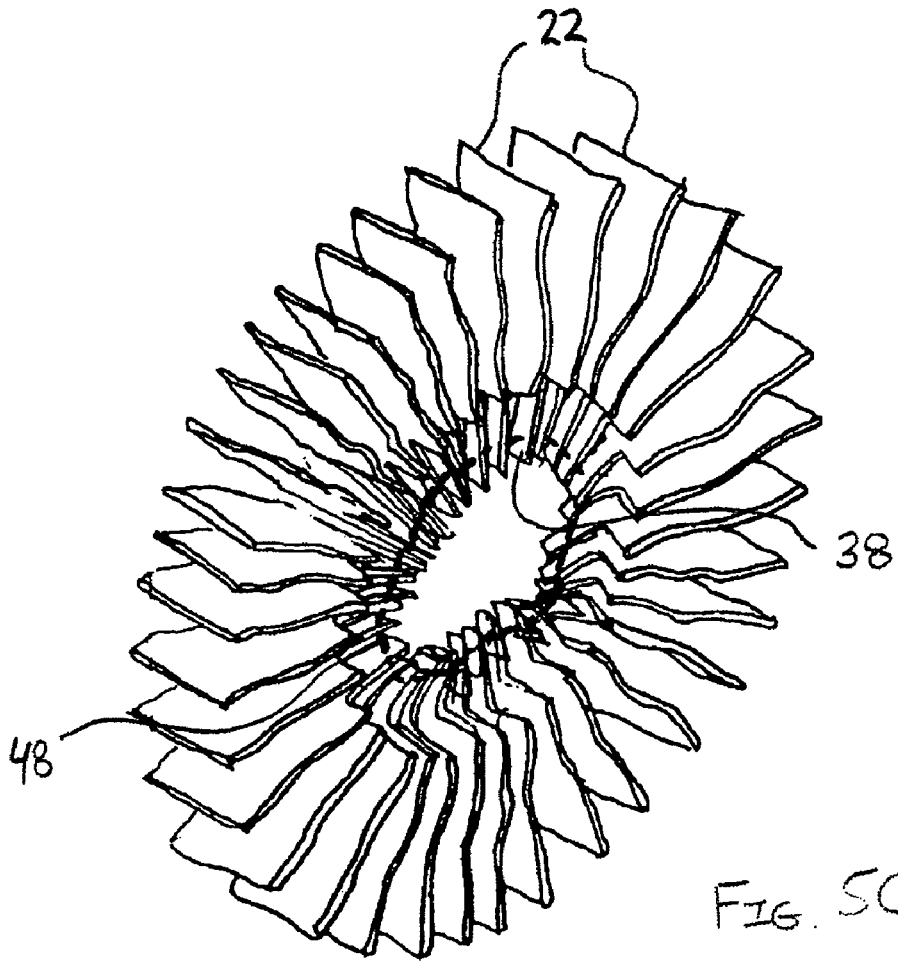
FIG. 5C is an isometric view of infant toy of FIG. 1 where the tags are connected by an annular support member.

As illustrated in FIGS. 5A-C, in certain embodiments, the tags 22 are connected about an annular support member 44, such that the plurality of tags 22 collectively form a ring of tags. For example, as shown in FIG. 5A, the support member 44 may pass through the tags 22, thereby securing them thereto. In some of these embodiments, the support member 44 is an elastomeric band or other flexible material. In other advantageous embodiments, as shown in the FIG. 5B, the support member 44 is a band of fabric, which may be elastic-lined. In other embodiments, as shown in FIG. 5C, the tags 22 may all connect to a small band 48 at their inner ends 38 such that essentially the entirety of each tag 22 extends out away from the wrist or other body part around which the band 48 is worn. As can be appreciated by one of ordinary skill in the art, the tags 22 can be connected to the annular support member in any of various ways. For instance, the tags 22 may be sewn, braided, or looped through (i.e., such that that the first and second ends of the strip of fabric are looped around the support member and connected to each other or by a thin piece of material such as plastic, rubber, etc.). In these ways, the plurality of tags 22 can form a bracelet or scrunchie that can be worn by any infant about the wrist or ankle or in the hair.

As illustrated in FIG. 2, in certain advantageous embodiments, the toy 20 includes a connector 50 for attaching the toy 20 to an accessory. For example, in certain advantageous embodiments, the connector 50 is adapted to allow the toy 20 to be attached to items for which infants normally reach and often attempt to stick in their mouth, such as key chains, zipper pulls, necklaces, and the like. As a result, the infant will likely grasp and mouth the toy 20 instead of such other items to which the toy 20 is attached.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A toy, comprising:
a core section having a maximum diameter;
a plurality of tags interconnected about said core section;
wherein each of said tags comprises an elongated piece of fabric;
wherein each of said tags has a length, the length being larger than the maximum diameter of said core section;
wherein each of said tags has a width and a thickness, the width being substantially larger than the thickness;
wherein said plurality of tags extend outwardly from said core section in a plurality of planes;
wherein each of said tags has an inner end and an outer end; and
wherein the inner ends of said plurality of tags are sewn together, such that said core section comprises the plurality of the inner ends of said plurality of tags.

2. The toy of claim 1, wherein:
each of said pieces of fabric includes a first end and a second end; and
said first and second ends are connected at said core section, such that said tag comprises a loop.

3. The toy of claim 1, wherein:
each of said tags extends out less than about three inches from said core section; and
the width of each of said tags is less than two inches.

4. The toy of claim 1, wherein:
each of said tags has an inner end and an outer end;
said core section comprises a substantially spherical body; and
the inner ends of said plurality of tags are affixed to said body.

5. The toy of claim 1, wherein the color of at least one of said tags is different than the color of at least one other of said tags.

6. The toy of claim 1, wherein the length of at least one of said tags is different than the length of at least one other of said tags.

7. The toy of claim 1, further comprising a handle member connected to said core section.

8. The toy of claim 1, further comprising a connector for attaching the toy to an accessory.

9. A toy, comprising:
a core section having a maximum diameter;
a plurality of tags interconnected about said core section;
wherein each of said tags comprises an elongated piece of fabric;
wherein each of said tags has a width and a thickness, the width being substantially larger than the thickness;
wherein said plurality of tags extend outwardly from said core section in a plurality of planes, said tags extending to a maximum distance away from said core section;
wherein the maximum distance said tags extend away from said core section is larger than the maximum diameter of said core section;
wherein each of said tags has an inner end and an outer end; and
wherein the inner ends of said plurality of tags are sewn together, such that said core section comprises the plurality of the inner ends of said plurality of tags.

10. The toy of claim 9, wherein:
each of said pieces of fabric includes a first end and a second end; and
said first and second ends are connected at said core section, such that said tag comprises a loop.

11. The toy of claim 9, wherein:
the maximum distance said tags extend away from said core section is less than about three inches; and
the width of each of said tags is less than two inches.

12. The toy of claim 9, wherein:
each of said tags has an inner end and an outer end;
said core section comprises a substantially spherical body; and
the inner ends of said plurality of tags are affixed to said body.

13. The toy of claim 9, wherein the color of at least one of said tags is different than the color of at least one other of said tags.

14. The toy of claim 9, wherein the length of at least one of said tags is different than the length of at least one other of said tags.

15. The toy of claim 9, further comprising a handle member connected to said core section.

16. The toy of claim 9, further comprising a connector for attaching the toy to an accessory.

17. A toy, comprising:
a core section having a maximum diameter;
a plurality of tags, each of said tags comprising an elongated piece of fabric having an inner end;
wherein each of said tags has a length, the length being larger than the maximum diameter of said core section;
wherein each of said tags has a width and a thickness, the width being substantially larger than the thickness;
wherein the plurality of inner ends of said tags are sewn together, such that the plurality of inner ends comprises said core section; and
wherein said plurality of tags extend outwardly from said core section in a plurality of planes.

18. The toy of claim 17, wherein:
each of said tags extends out less than about three inches from said core section; and
the width of each of said tags is less than two inches.

19. The toy of claim 17, wherein the color of at least one of said tags is different than the color of at least one other of said tags.

20. The toy of claim 17, further comprising a handle member connected to said core section.

21. The toy of claim 17, further comprising a connector for attaching the toy to an accessory.

* * * * *